US011043199B2

(12) United States Patent
Lee et al.

(10) Patent No.: US 11,043,199 B2
(45) Date of Patent: Jun. 22, 2021

(54) SPARSE ACOUSTIC ABSORBER

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 541 days.

(21) Appl. No.: 15/962,513

(22) Filed: Apr. 25, 2018

(65) Prior Publication Data

US 2019/0333491 A1 Oct. 31, 2019

(51) Int. Cl.
*G10K 11/172* (2006.01)

(52) U.S. Cl.
CPC ..... *G10K 11/172* (2013.01)

(58) Field of Classification Search
CPC . G10K 11/172; G10K 11/168; F02M 35/1255
USPC ..... 181/224, 223, 227, 286
See application file for complete search history.

(56) References Cited

U.S. PATENT DOCUMENTS 4,562,901 A * 1/1986 Junger ..... E04B 1/8404 181/285
5,962,823 A * 10/1999 Asahara ..... G10K 11/172 181/286
5,997,985 A * 12/1999 Clarke ..... B32B 3/12 428/116
6,012,543 A * 1/2000 Shimpo ..... B60R 13/08 181/286
7,117,974 B2 10/2006 Moenssen
8,307,947 B2 * 11/2012 Bussow ..... F16L 55/0331 181/224

(Continued)

FOREIGN PATENT DOCUMENTS

WO WO-2019021483 A1 * 1/2019 ..... G10K 11/168

OTHER PUBLICATIONS

Cheng, Y. et al., "Ultra-sparse metasurface for high reflection of low-frequency sound based on artificial Mie resonances," Nature Materials, vol. 14, pp. 1013-1020 (Oct. 2015).

(Continued)

*Primary Examiner* — Forrest M Phillips
(74) *Attorney, Agent, or Firm* — Christopher G. Darrow; Darrow Mustafa PC

(57) ABSTRACT

A sparse acoustic absorber includes a periodic array of spaced apart unit cells, generally having a lateral fill factor less than 0.5. Each unit cell includes a pair of joined, and inverted, Helmholtz resonators, having neck portions that point in opposite directions. This structure enables ambient fluid, such as air, to pass through the absorber. The absorber predominantly absorbs acoustic waves having a resonant frequency when such waves are incident on the absorber in one direction, and predominantly reflect such waves when they are incident on the absorber in the opposite direction. Dual-function sound suppression systems incorporate such an absorber into a porous substrate, such as a wire mesh, that enables fluid to pass and alternatively absorbs or reflects sound.

20 Claims, 5 Drawing Sheets

(56) References Cited

U.S. PATENT DOCUMENTS

| | | | | |
|---|---|---|---|---|
| 2003/0072459 | A1* | 4/2003 | Cole | B29C 45/006 381/71.7 |
| 2003/0173146 | A1* | 9/2003 | Wolf | F02M 35/1211 181/224 |
| 2003/0221904 | A1* | 12/2003 | Ludwig | F16L 55/02736 181/224 |
| 2005/0045416 | A1* | 3/2005 | McCarty | B01F 5/0456 181/224 |
| 2006/0272886 | A1* | 12/2006 | Mueller | F02C 7/24 181/224 |
| 2010/0077755 | A1* | 4/2010 | Jangili | F16L 55/02754 60/725 |
| 2012/0090915 | A1* | 4/2012 | Cheung | F02M 35/1233 181/224 |
| 2020/0139902 | A1* | 5/2020 | Furuzawa | G10K 11/172 |

OTHER PUBLICATIONS

Cai, C. et al., "Acoustic performance of different Helmholtz resonator array configurations," Applied Acoustics, 130, pp. 204-209 (2018).

Xu, M.B. et al., "Dual Helmholtz resonator," Applied Acoustics, 71, pp. 822-829 (2010).

U.S. Appl. No. 16/296,403, filed Mar. 8, 2019 (not yet published).

U.S. Appl. No. 16/227,345, filed Dec. 20, 2018 (not yet published).

U.S. Appl. No. 16/296,412, filed Mar. 8, 2019 (not yet published); and, Oct. 15, 2020.

U.S. Appl. No. 16/025,630, filed Jul. 2, 2018 (not yet published).

* cited by examiner

SPARSE ACOUSTIC ABSORBER

TECHNICAL FIELD

The present disclosure generally relates to acoustic metamaterials and, more particularly, to acoustic absorption metamaterials that are porous to ambient fluid.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Acoustic metamaterials having elastic acoustic properties that differ from those of their constituent materials are known. Such metamaterials have arrays of periodic structures, typically on a scale smaller than the target wavelength. Such metamaterials are typically solid surfaces that are impermeable to ambient fluid (e.g. air) and modulate sound in only one direction.

Accordingly, it would be desirable to provide an improved acoustic material having sparse (spaced apart) unit cells that allow air to flow freely between the unit cells, and that can modulate incident sound in two opposite directions.

SUMMARY

This section provides a general summary of the disclosure, and is not a comprehensive disclosure of its full scope or all of its features.

In various aspects, the present teachings provide an acoustic absorber. The acoustic absorber includes a periodic array of laterally spaced-apart, two-sided Helmholtz resonators. The periodic array further includes a plurality of unit cells spaced apart by a lateral midpoint-to-midpoint distance P, each unit cell having a maximum lateral dimension W, wherein P is greater than W. Each unit cell includes first and second Helmholtz resonators. The first Helmholtz resonator includes a first chamber portion bounded by at least one first boundary wall defining a first chamber volume. The second Helmholtz resonator includes a second chamber portion bounded by at least one second boundary wall defining a second chamber volume and a second neck forming an opening on a second side of the at least one second boundary wall and placing the second chamber portion in fluid communication with the ambient environment. The first side of the at least one first boundary wall and the second side of the at least one second boundary wall are on opposite sides of the unit cell, and the second chamber volume is greater than the first chamber volume.

In other aspects, the present teachings provide a dual-function sound suppression system. The system includes a substrate that is porous to a surrounding medium, the substrate having a continuous solid material having periodic apertures interspersed therein. The system also includes a periodic array of unit cells incorporated in the substrate. The periodic array includes a plurality of unit cells spaced apart by a lateral midpoint-to-midpoint distance P, each unit cell having a maximum lateral dimension W, wherein P is greater than W. Each unit cell includes first and second Helmholtz resonators. The first Helmholtz resonator includes a first chamber portion bounded by at least one first boundary wall defining a first chamber volume. The second Helmholtz resonator includes a second chamber portion bounded by at least one second boundary wall defining a second chamber volume and a second neck forming an opening on a second side of the at least one second boundary wall and placing the second chamber portion in fluid communication with the ambient environment. The first side of the at least one first boundary wall and the second side of the at least one second boundary wall are on opposite sides of the unit cell, and the second chamber volume is greater than the first chamber volume.

In still other aspects, the present teachings provide a fan coated with a sound suppression system. The fan includes a fan configured to move air in response to an electric current, and a sound suppression system coating or shielding the fan. The sound suppression system is as described above.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present teachings provide a sparse acoustic absorber. The disclosed acoustic absorber provides a structure that reflects or absorbs sound (depending on direction), while allowing fluid to pass through.

The present technology provides an asymmetric, bidirectional noise reduction device/structure. In one direction, the structure is an acoustic reflector, reducing noise by reflecting sound waves. In the opposite direction, the structure is an acoustic absorber, reducing and dampening noise. Because of its sparse structure, fluids such as ambient air can freely pass through the structure.

The sparse absorber has unique applicability in any application that benefits from sound dampening, while allowing air or other fluid to pass freely through. In an example, the sparse absorber could be wrapped around or placed in front of a fan, rendering the fan silent while allowing air to blow through.

Figure 1A:
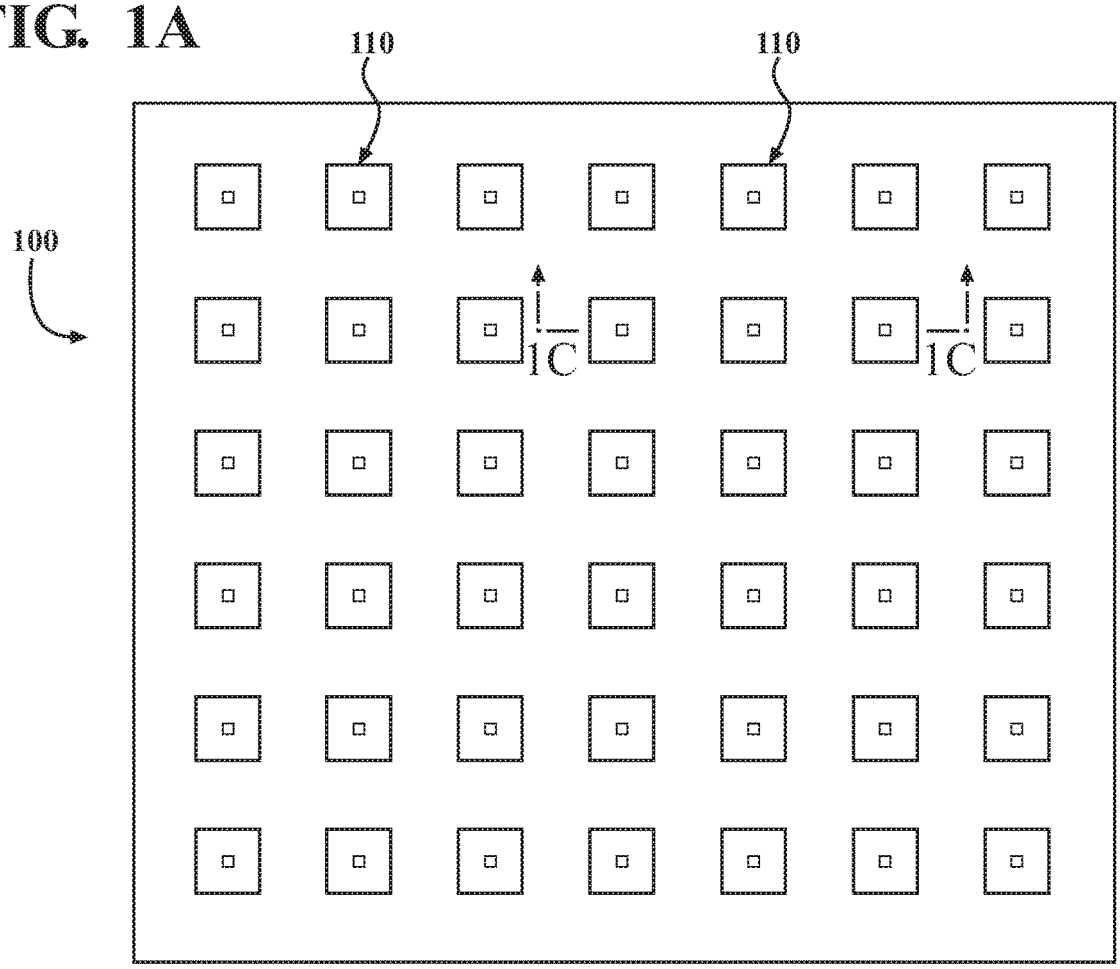
FIG. 1A is a schematic top plan view of a portion of a sparse acoustic absorber.
Figure 1B:
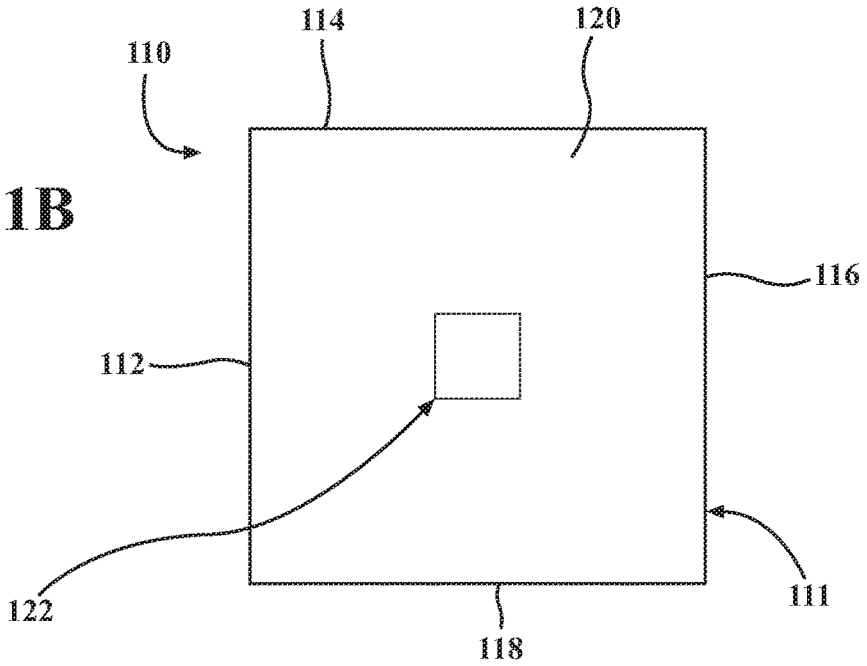
FIG. 1B is a magnified view of a unit cell of the absorber of FIG. 1A.
Figure 1C:
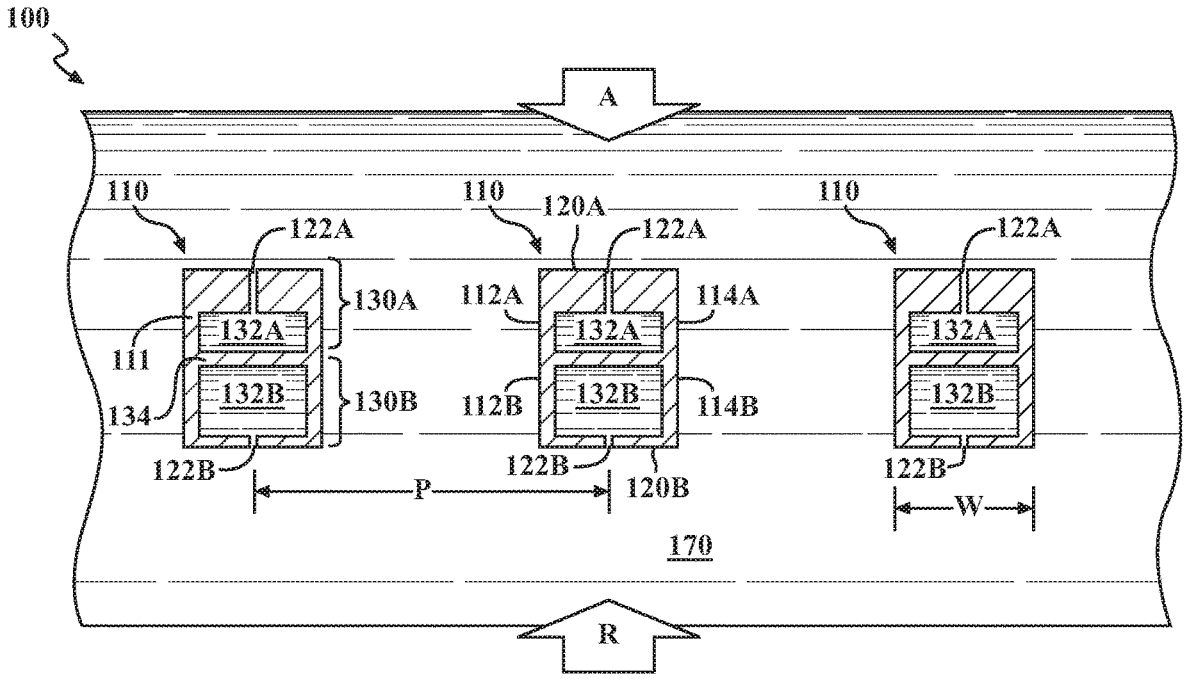
FIG. 1C is a schematic side cross-sectional view of three unit cells of the absorber of FIG. 1A, viewed along the line 1C-1C.

FIG. 1A shows a top plan view of a portion of a disclosed sparse acoustic absorber 100, having an array of periodic unit cells 110, while FIG. 1B shows a magnified view a single unit cell 110, viewed from the same direction as in the view of FIG. 1A. FIG. 1C shows a side cross-sectional view, taken along the line 1C-1C, of a portion of sparse acoustic absorber 100 of FIG. 1A, and including only three unit cells 110. With particular reference to FIG. 1A, the unit cells 110 can be periodic in 2-dimensions (e.g. x,y), as in the example of FIG. 1A. Each unit cell 110 includes at least one enclosure wall, although the unit cell 110 of FIGS. 1A-1C includes multiple enclosure walls, such as side walls 112, 114, 116, and 118, and end wall 120, as indicated in FIG. 1B. Each unit cell 110 further includes a neck 122, defining an aperture passing through the end wall 120.

In the example of FIG. 1A, the periodic array of unit cells 110 has periodicity in both x and y dimensions. This can be termed a two-dimensional array. While the unit cells 110 of FIG. 1A are shown as having a substantially square surface profile, they can alternately have a surface profile that is non-square rectangular, circular, triangular, ovoid, or any other regular shape. In some implementations in which the periodic array of unit cells 110 is a two-dimensional array, the two-dimensional array can have 90° rotational symmetry about an axis perpendicular to the surface of the absorber 100.

The period, P, of the array of periodic array of unit cells 110 will generally be substantially smaller than the wavelength of the acoustic waves that the sparse acoustic absorber 100 is designed to absorb. As shown in FIG. 1C, the period can be equated to a center-to-center distance between adjacent unit cells. In different implementations, the period of the periodic array of unit cells 110 will be less than 0.1 or less than 0.01 of the wavelength of the acoustic waves that the sparse acoustic absorber 100 is designed to absorb, i.e. the resonance frequency/wavelength of the absorber 100. For example, in some implementations, the sparse acoustic absorber 100 can be designed to absorb acoustic waves of a human-audible frequency, having a wavelength within a range of a few millimeters (mm) to a few tens of meters. In such implementations, the periodic array of unit cells 110 can have a period within a range of from about ten or several tens of μm to about one mm. In some implementations, the sparse acoustic absorber 100 will be designed to absorb acoustic waves in the MHz frequency range, such as those having a wavelength within a range of from about one hundred μm to about two mm. In such implementations, the sparse acoustic absorber 100 can have a period within a range of about one μm to about one hundred μm. In certain implementations, the sparse acoustic absorber 100 can have a period within a range of from about one-quarter to one-half of its resonance wavelength.

Figure 1D:
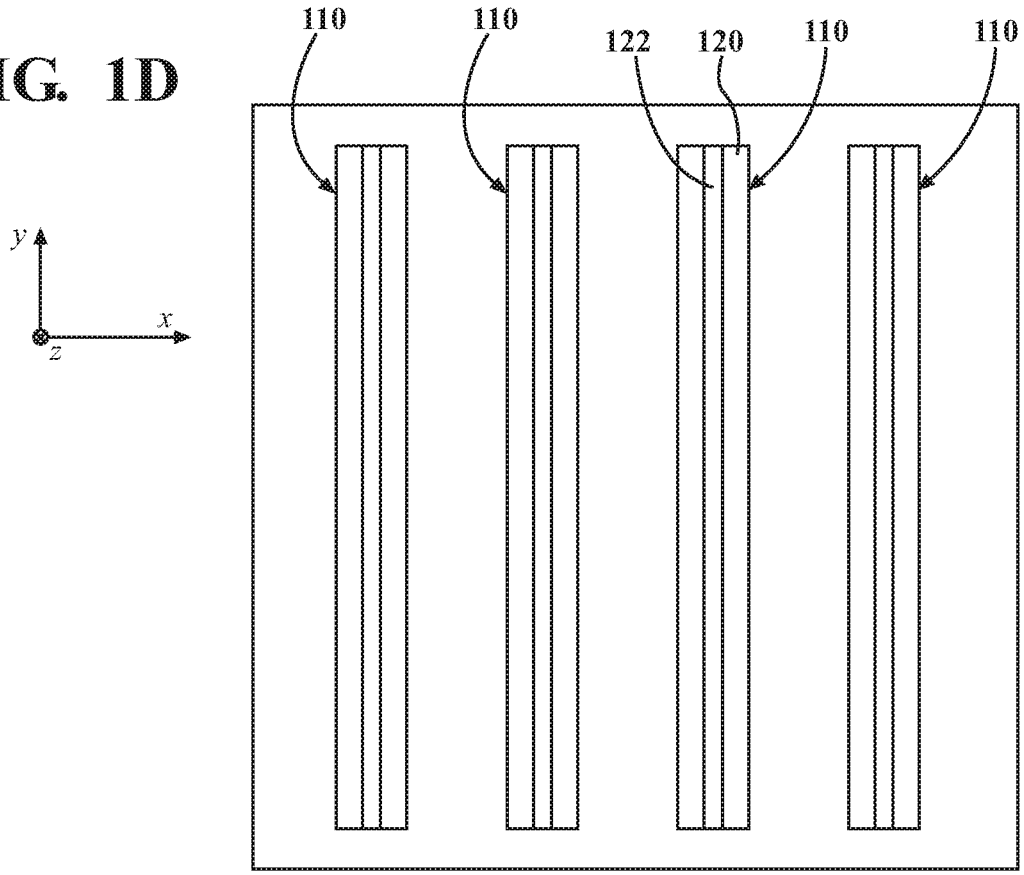
FIG. 1D is a top plan view of a variant of the sparse acoustic absorber of the type shown in FIG. 1A, having a one-dimensional array of unit cells.
Figure 1E:
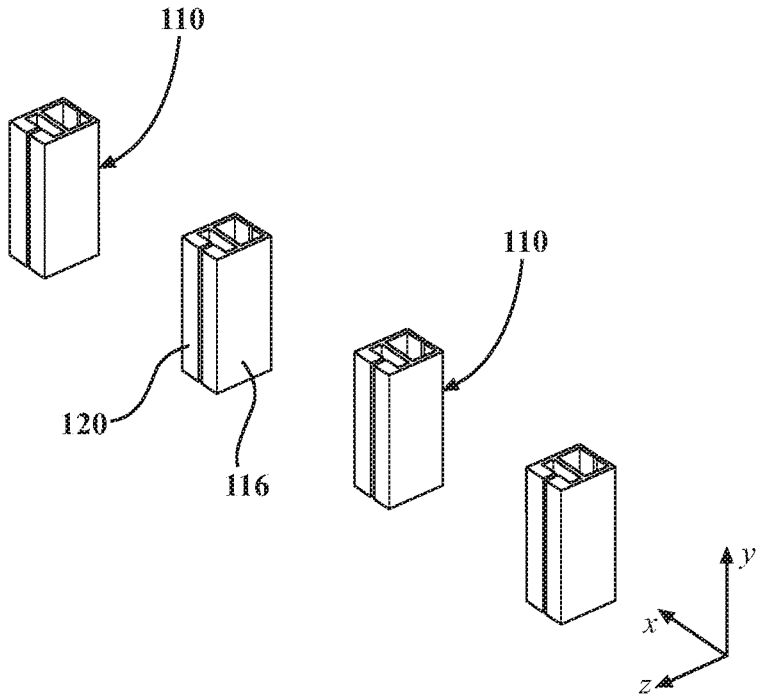
FIG. 1E is a perspective view of several unit cells of the one-dimensional array of FIG. 1D.

With reference to FIGS. 1D and 1E, the periodic array of unit cells 110 can alternatively be periodic in one dimension only. FIG. 1D shows a top plan view of such a one-dimensional periodic array of unit cells 110, periodic in the x-dimension, and FIG. 1E shows a perspective view of the array of FIG. 1D. As shown in the example of FIGS. 1D and 1E, when an array is periodic in one-dimension (e.g. the x-dimension), each unit cell 110 will typically be elongated in the y-dimension.

Each unit cell 110 of the periodic array of unit cells 110 will generally have a maximum lateral dimension, or width W. It will be understood that in the case of a one-dimensional array, such as that of FIGS. 1D and 1E, the maximum lateral dimension is only in the direction of periodicity (e.g. the x-dimension), and not in the elongated direction (e.g. the y-dimension). The periodic array of unit cells 110 is further characterized by a fill factor equal to P/W. In general, the fill factor will be 0.5 or less. In some implementations, the fill factor will be 0.25 (i.e. 25%) or less. It will be appreciated that the resonant frequency of the periodic phase—i.e. the periodic array of unit cells 110—is substantially determined by the fill factor of the periodic array of unit cells 110; the ratio of period to width of unit cells 110. As noted above, the period of the periodic array of unit cells 110 is smaller than the wavelength corresponding to the desired resonance frequency (period<wavelength). At the same time, in many implementations the period and width of unit cells 110 will be chosen so that the periodic array of unit cells 110 has a fill factor of at least 0.2 (i.e. 20%).

In some implementations, the unit cells 110 of the sparse acoustic absorber 100 can be positioned periodically on a porous substrate, through which ambient fluid 170 can pass with little constraint. Such a porous substrate could be a mesh or screen, such as an air screen of the type used in a window, a sheet of material having periodic apertures or perforations, or any other suitable substrate.

Referring now more particularly to FIG. 1C, each unit cell 110 of the sparse acoustic absorber 100 includes first and second Helmholtz resonators 130A and 130B. Each of the first and second Helmholtz resonators 130A, 130B includes a chamber 132A, 132B, respectively, bounded by the at least one enclosure wall 111 and by at least one partition wall 134. In the example illustrated in FIG. 1B, the first Helmholtz resonator 130A is bounded by side walls 112A and 116A; by the end wall 120A; and by the partition wall 134; as well as by side walls 114A and 118A which are not visible in the view of FIG. 1C. Similarly, the second Helmholtz resonator 130B is bounded by side walls 112B and 116B; by the end wall 120B; and by the partition wall 134; as well as by side walls 114B and 118B which are not visible in the view of FIG. 1C. Each of the first and second Helmholtz resonators 130A, 130B includes a neck 122A, 122B passing through the end wall 120A, 120B, and thereby placing the chamber 132A, 132B in fluid communication with the ambient environment. Thereby, an ambient fluid 170, such as air, can pass in and out of the chambers 132A, 132B through the necks 122A, 122B. However, because the partition wall 134 is impermeable to ambient fluid 170, ambient fluid 170, such as air, cannot pass directly between the first and second Helmholtz resonators 130A, 130B.

While the unit cell 110 of FIGS. 1A and 1B defines a substantially rectangular prismatic shape, it is to be understood that a unit cell 110 of the present teachings can include any suitable shape, such as cylindrical, conical, spherical, ovoid, or any other shape that is suitable to enclose first and second Helmholtz resonators 130A, 130B separated by at least one partition wall 134. It will therefore be understood that a unit cell 110 need not necessarily have first and second end walls 120A, 120B and that therefore first and second necks 122A, 122B need not necessarily pass through an "end wall". In general, the first and second necks 122A, 122B will be positioned on opposite sides of the unit cell 110, and will be substantially parallel to an axis, z, that is perpendicular to the x-axis or x,y-axes defining periodicity of the array of unit cells 110. In general, the maximum width of a chamber 132A, 132B will be substantially greater than the maximum width of its associated neck 122A, 122B.

It will further be understood that each chamber 132A, 132B defines a volume, corresponding to the volume of ambient fluid 170 that can be held in the chamber 132A, 132B, exclusive of the neck 122A, 122B. The volume of the second chamber 132B will generally be greater than the volume of the first chamber 132A. It will further be understood that each of the first and second necks 122A, 122B has a length. In general, the length of the first neck 122A will be greater than the length of the second neck 122B. Thus, the first Helmholtz resonator 130A generally has a longer neck 122A and a smaller (lower volume) chamber 132A than does the second Helmholtz resonator 130B.

The at least one enclosure wall and the end wall 120 will typically be formed of a solid, sound reflecting material. In general, the material or materials of which the at least one enclosure wall and the end wall 120 are formed will have acoustic impedance higher than that of ambient fluid 170. Such materials can include a thermoplastic resin, such as polyurethane, a ceramic, or any other suitable material.

Referring to FIG. 1C, when an acoustic wave approaches the device from the direction indicated by the arrow, A, the device operates in what can be termed "absorption mode". When an acoustic wave approaches the device from the opposite direction, the device operates in what can be termed "Reflection mode." In absorption mode, sound is blocked by the absorption of the structure, while the ambient fluid 170 can flow. The incident acoustic energy is dissipated to heat in the first neck 122A via viscous loss. It will be appreciated that the first Helmholtz resonator 130A has higher viscous loss than does the second Helmholtz resonator 130B. The sound propagation direction shown in FIG. 1 is for acoustic absorption mode.

Figure 2A:
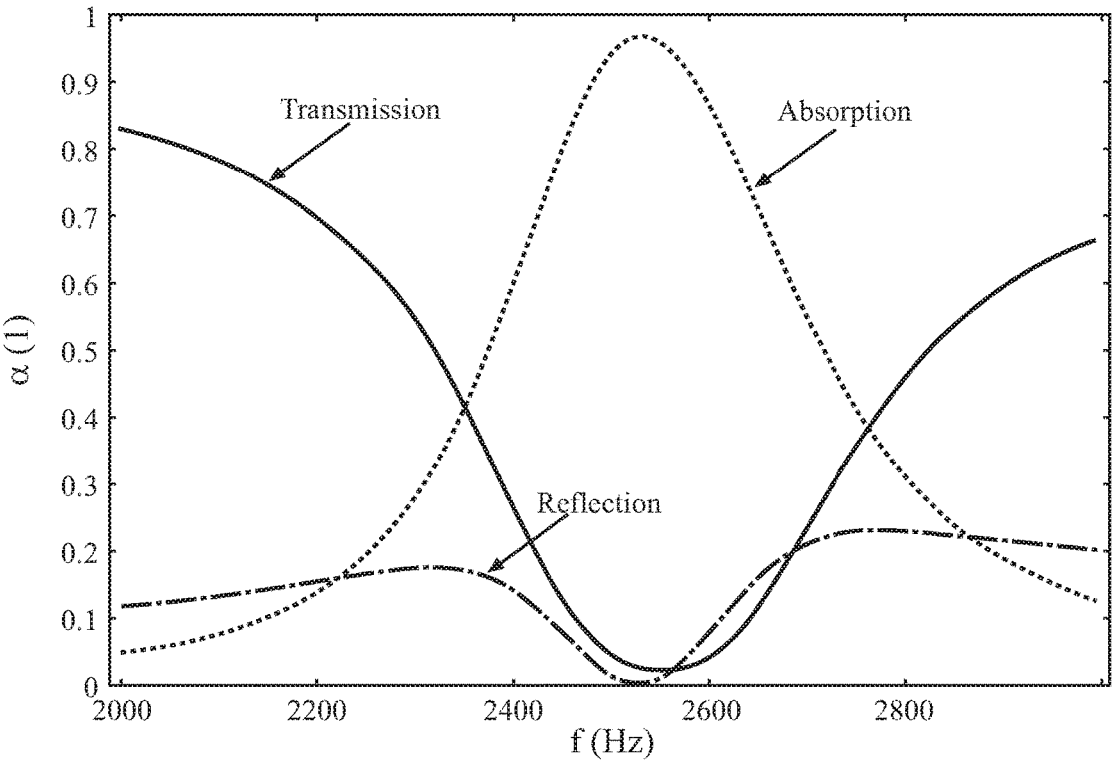
FIG. 2A is a graph of acoustic transmission, reflection, and absorption as a function of frequency for the sparse acoustic absorber of FIGS. 1A and 1B.
Figure 2B:
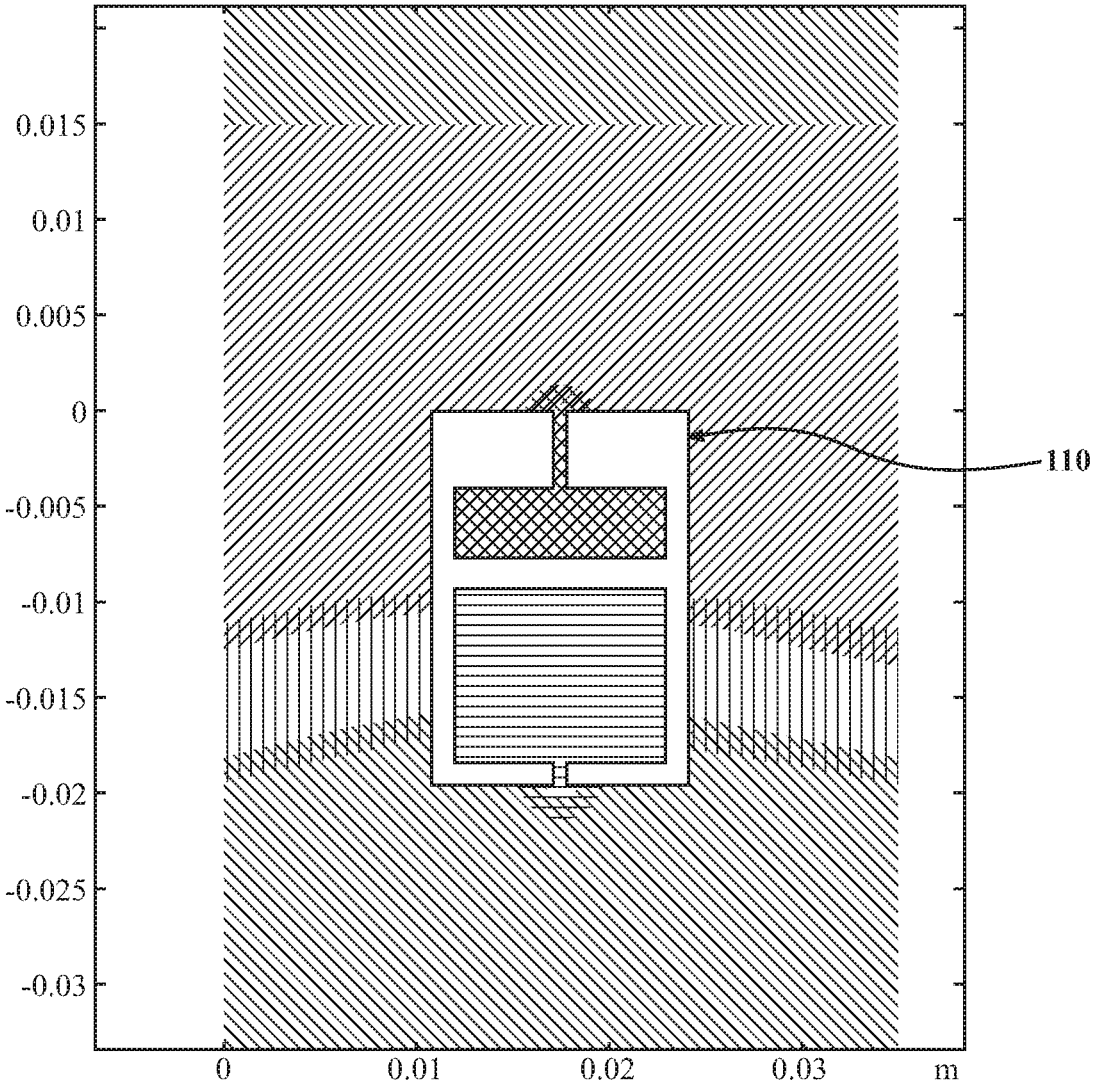
FIG. 2B is a plot of acoustic pressure distribution at the resonance frequency for the absorber of FIGS. 1A and 1B.

FIG. 2A is a graph of acoustic transmission, reflection, and absorption as a function of frequency for a sparse acoustic absorber 100 of the present teachings. The simulated results of FIG. 2A are for an absorber having a fill factor of 25%, with acoustic waves approaching from the direction of the arrow, A that is shown in FIG. 1C. It will be observed that the absorber 100 demonstrates strong acoustic absorption at the resonance frequency—in this example centered at 2.5 KHz, and allows very low transmission at the resonance frequency. It will further be observed that reflection is very low at the resonance frequency, such that nearly all of the sound is absorbed at the resonance frequency. FIG. 2B shows acoustic pressure distribution at the resonance frequency (2.5 KHz) for the absorber whose acoustic properties are shown in FIG. 2A. As can be seen from the schematic image of FIG. 2B, acoustic energy is concentrated primarily around the neck 122A of the first Helmholtz resonators 130A, but also significantly around the neck 122B of the second Helmholtz resonators 130B. This result highlights the contribution that both Helmholtz resonators 130A, 130B make to the absorption properties of the absorber 100 when operating in absorption mode.

However, if acoustic waves impinge on the absorber 100 from the opposite direction, indicated by the arrow, R, in FIG. 1C, the absorber 100 has an altered function, operating primarily as a reflector. In this instance, the incident acoustic waves arrive at the side of the second Helmholtz resonator 130B. When the absorber 100 is used in this manner, the absorption and reflection curves of FIG. 2A are substantially switched with one another, so that the incident acoustic waves are predominantly reflected, rather than absorbed, as described above in reference to absorption mode and reflection mode. Thus, depending on whether acoustic absorption or reflection is desired, the absorber 100 can be positioned relative to an acoustic source in either of two general orientations, to achieve the desired outcome. An absorber 100 of the present teachings can thus be alternatively referred to as a "reversible, dual-function acoustic absorber/reflector". While not shown graphically here, both Helmholtz absorbers 130A, 130B likewise contribute to the reflective properties of the absorber 100 when operating in reflection mode.

Figure 3:
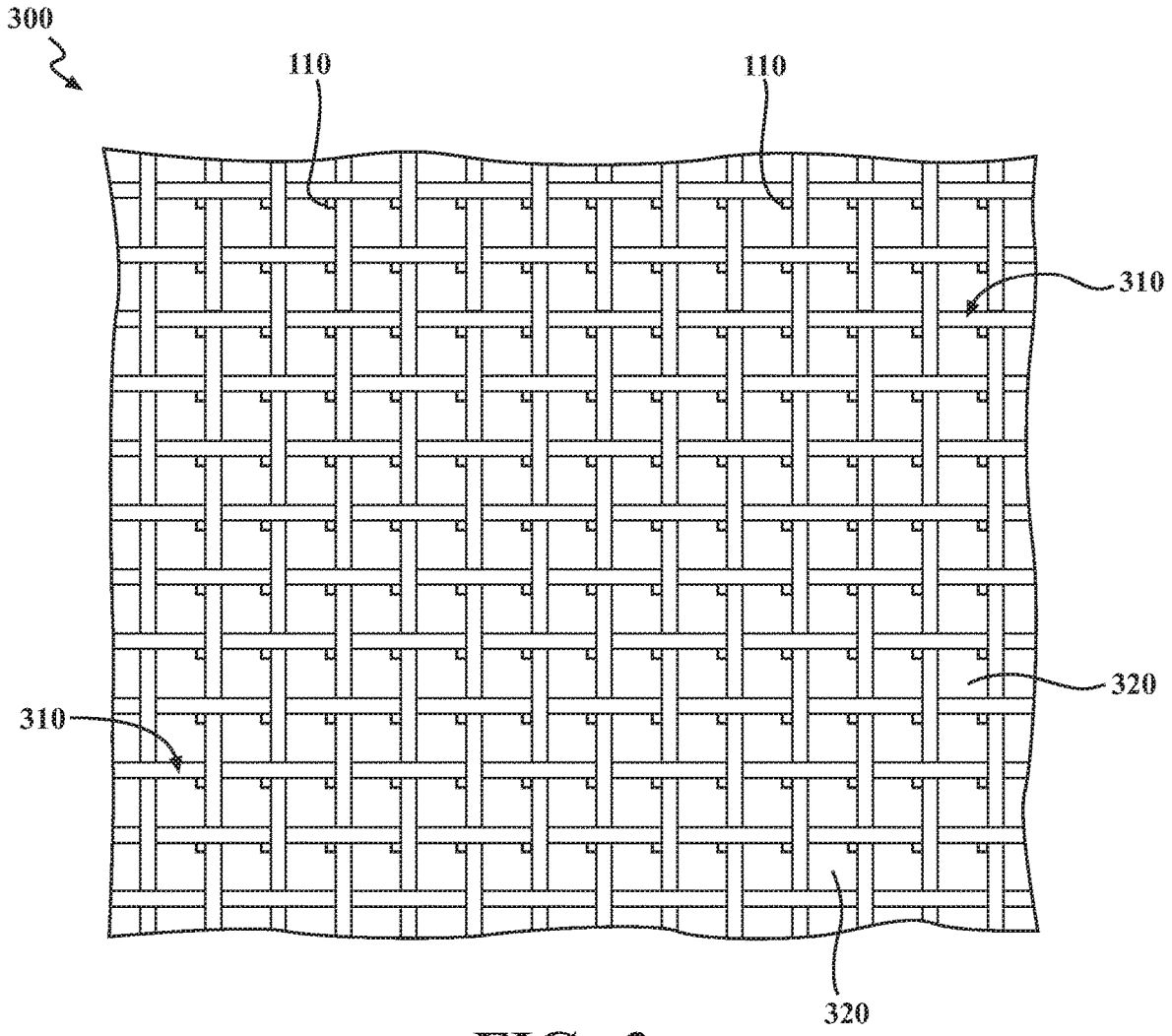
FIG. 3 is a schematic top plan view of a portion of a dual-function sound suppression system incorporating a sparse acoustic absorber of the type shown in FIG. 1A.

FIG. 3 shows a schematic, top plan view of a disclosed, dual-function sound suppression system 300. The dual-function sound suppression system 300 includes a substrate 310 that is porous to a surrounding medium, such as air. Examples of such a porous substrate can include a mesh or screen, such as an air screen of the type used in a window, a sheet of material having periodic apertures or perforations, or any other suitable substrate, as described above. The substrate 310 is generally composed of a continuous solid material, that may be, but need not necessarily be, flexible. Suitable solid materials for the substrate 310 and can include metals, plastics, and the like. The system further includes periodic apertures 320 that provide the substrate 310 with its porosity.

The system 300 further includes unit cells 110 of a sparse acoustic absorber 100, as described above, positioned in the apertures 320 of the substrate 310. The unit cells 110 can be positioned so that first and second necks 122A, 122B are substantially perpendicular to the two-dimensional surface of the substrate 310, and may be positioned on aperture edges, as shown in FIG. 3. The system can define a substrate fill factor, which is the two-dimensional surface of the system occupied by substrate, divided by the two dimensional surface of the system that is occupied by aperture (i.e. that is unoccupied). This can alternatively be referred to as inverse substrate porosity. In general, the substrate fill factor will be substantially lower than is the fill factor of the absorber 100 that is incorporated in the substrate. For example, the fill factor of the absorber 100 as incorporated in the substrate 300 can have a fill factor in a range of about 0.1 to 0.25, while the substrate fill factor may be 0.05 or less. This allows the system to remain porous with the incorporated absorber 100.

The substrate 310 will generally be substantially planar—although as noted above, it can be flexible—having first and second planar surfaces. Due to the dual absorption mode/reflection mode of the array of unit cells 110, as described above, the system will predominantly absorb acoustic waves at or near a resonant frequency when such waves are incident on one of the planar sides; and will predominantly reflect acoustic waves at or near the resonant frequency when such waves are incident on the other of the two planar sides.

In an example, a dual-function sound suppression system 300 can be used as a window screen that allows air flow through an open window. In such an implementation, the screen can absorb sound arriving at the window from one side, and reflect sound arriving at the window from the opposite side. It will be understood that such a sound suppression system 300 can have utility in any scenario where fluid flow is desirable, and either or both of sound absorption and sound reflection is useful. For example, a disclosed sound suppression system 300 can be useful as a coating or shield for any device that benefits from air or fluid flow and also produces sound, such as a fan or other mechanical blower, or a noise producing mechanism having an air intake. In an example, a fan that is shielded with a sound suppression system 300 could be deployed in a motor vehicle, such as a fan that circulates air in a passenger cabin, a turbocharger, or a turbine fan on a jet engine.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. An acoustic absorber comprising a periodic array of laterally spaced-apart, two-sided Helmholtz resonators, the periodic array comprising:

a plurality of unit cells spaced apart by a lateral midpoint-to-midpoint distance P, each unit cell having a maximum lateral dimension W, wherein P is greater than W, and having a fill factor is less than 0.5, each unit cell comprising:

a first Helmholtz resonator having:

a first chamber portion bounded by at least one first boundary wall defining a first chamber volume; and a first neck forming an opening on a first side of the at least one first boundary wall and placing the first chamber portion in fluid communication with an ambient environment; and a second Helmholtz resonator having:

a second chamber portion bounded by at least one second boundary wall defining a second chamber volume; and a second neck forming an opening on a second side of the at least one second boundary wall and placing the second chamber portion in fluid communication with the ambient environment;

wherein the first side of the at least one first boundary wall and the second side of the at least one second boundary wall are on opposite sides of the unit cell, and the second chamber volume is greater than the first chamber volume.

2. The acoustic absorber as recited in claim 1, wherein W is less than or equal to 0.5P.

3. The sparse acoustic absorber as recited in claim 1, wherein W is less than or equal to 0.25P.

4. The acoustic absorber as recited in claim 1, wherein a length of the first neck is greater than a length of the second neck.

5. The sparse acoustic absorber as recited in claim 1, wherein P is within a range of from about one-quarter to one-half of a resonance wavelength of the absorber.

6. The sparse acoustic absorber as recited in claim 1, wherein the periodic array of unit cells comprises a two-dimensional array.

7. The sparse acoustic absorber as recited in claim 6, wherein the two-dimensional array comprises:

unit cells spaced apart by an equivalent lateral midpoint-to-midpoint distance, P, in the first and second dimensions;

wherein each unit cell has an equivalent maximum lateral dimension W, in each of the two dimensions.

8. The sparse acoustic absorber as recited in claim 1 that is configured to absorb acoustic waves at a resonant frequency incident on the absorber from a first direction, and to predominantly reflect acoustic waves at the resonant frequency incident on the absorber from a second direction substantially opposite to the first direction.

9. A dual-function sound suppression system comprising:

a substrate that is porous to a surrounding medium, the substrate comprising a continuous solid material having periodic apertures interspersed therein; and a periodic array of unit cells incorporated in the substrate, the unit cells spaced apart by a lateral midpoint-to-midpoint distance P, each unit cell having a maximum lateral dimension W, wherein P is greater than W, and each unit cell comprising:

a first Helmholtz resonator having:

a first chamber portion bounded by at least one first boundary wall defining a first chamber volume; and a first neck forming an opening on a first side of the at least one first boundary wall and placing the first chamber portion in fluid communication with an ambient environment; and a second Helmholtz resonator having:

a second chamber portion bounded by at least one second boundary wall defining a second chamber volume; and a second neck forming an opening on a second side of the at least one second boundary wall and placing the second chamber portion in fluid communication with the ambient environment;

wherein the first side of the at least one first boundary wall and the second side of the at least one second boundary wall are on opposite sides of the unit cell, and the second chamber volume is greater than the first chamber volume; and wherein the first neck and the second neck define openings in opposite directions.

10. The system as recited in claim 9, wherein the substrate is substantially planar, having first and second planar sides.

11. The system as recited in claim 10, wherein the system predominantly absorbs acoustic waves at or near a resonant frequency when such waves are incident on one of the planar sides, and predominantly reflects acoustic waves at or near the resonant frequency when such waves are incident on the other of the planar sides.

12. The system as recited in claim 9, wherein the substrate comprises a metal or plastic mesh.

13. The system as recited in claim 9, wherein W is less than or equal to 0.5P.

14. The system as recited in claim 9, wherein W is less than or equal to 0.25P.

15. The system as recited in claim 9, wherein a length of the first neck is greater than a length of the second neck.

16. The system as recited in claim 9, wherein P is within a range of from about one-quarter to one-half of a resonance wavelength of the absorber.

17. The system as recited in claim 9, wherein the substrate is characterized by a substrate fill factor that is substantially lower than a fill factor of the periodic array of unit cells.

18. A fan coated with a sound suppression system comprising:

a fan configured to move air in response to an electric current;

a sound suppression system coating or shielding the fan, the system comprising:

a substrate that is porous to a surrounding medium, the substrate comprising a continuous solid material having periodic apertures interspersed therein; and a periodic array of unit cells incorporated in the substrate, the unit cells spaced apart by a lateral midpoint-to-midpoint distance P, each unit cell having a maximum lateral dimension W, wherein P is greater than W, and having a fill factor is less than 0.5, each unit cell comprising:

a first Helmholtz resonator having:

a first chamber portion bounded by at least one first boundary wall defining a first chamber volume; and a first neck forming an opening on a first side of thee at least one first boundary wall and placing the first chamber portion in fluid communication with an ambient environment; and a second Helmholtz resonator having:

a second chamber portion bounded by at least one second boundary wall defining a second chamber volume; and a second neck forming an opening on a second side of the at least one second boundary wall and placing the second chamber portion in fluid communication with the ambient environment;

wherein the first side of the at least one first boundary wall and the second side of the at least one second boundary wall are on opposite sides of the unit cell, and the second chamber volume is greater than the first chamber volume.

19. The fan as recited in claim 18, wherein the substrate is substantially planar, having first and second planar sides.

20. A motor vehicle comprising the fan as recited in claim 18.

* * * * *